United States Patent [19]

Roy

[11] 3,994,045

[45] Nov. 30, 1976

[54] EASEL HINGE

[75] Inventor: Leo T. Roy, South Attleboro, Mass.

[73] Assignee: Craft, Inc., South Attleboro, Mass.

[22] Filed: Aug. 11, 1975

[21] Appl. No.: 603,788

[52] U.S. Cl. ..... 16/178; 16/191; 16/172

[51] Int. Cl.[2] ..... E05D 1/04

[58] Field of Search ..... 16/191, 189, 178, 179, 16/171, 128 R, 176, 172

[56] References Cited

UNITED STATES PATENTS

| | | | |
|---|---|---|---|
| 880,757 | 3/1908 | Rugg | 16/178 X |
| 1,566,236 | 12/1925 | Skurdal | 16/178 X |
| 1,893,592 | 1/1933 | Newman | 16/178 X |
| 2,811,741 | 11/1957 | Miller et al. | 16/191 |
| 2,857,618 | 10/1958 | Jordan | 16/191 X |
| 3,080,603 | 3/1963 | Spiselman | 16/191 |

*Primary Examiner*—G. V. Larkin
*Attorney, Agent, or Firm*—Salter & Michaelson

[57] ABSTRACT

An easel hinge for supporting picture frames and the like comprising an outer hinge plate and an inner hinge plate both having curled barrels, the inner barrel being positioned within the outer barrel for relative rotational movement therewith without the use of a separate hinge pin, such movement limited by stop means provided by the longitudinal free edge of the outer curl and means for preventing the relative longitudinal movement of said hinge plates comprising an inner barrel tab positioned within an outer barrel slot.

8 Claims, 12 Drawing Figures

EASEL HINGE

BACKGROUND OF THE INVENTION

Hinges of the type permitting a limited relative angular separation between their plates, generally less than 90°, are well known in the art. Such hinges have as one use, the interconnection of the support and backing of an easel-type picture frame and are thus generally referred to as easel hinges. Generally such easel hinges utilize a separate hinge pin to assemble and hold the opposed hinge plates in operative position. Examples of such easel hinges are found in U.S. Pat. No. 139,290 dated May 27, 1873; U.S. Pat. No. 1,501,013 dated July 8, 1924; and U.S. Pat. No. 2,811,741 dated Nov. 5, 1957. The use of such pins, in addition to adding to the physical cost of the hinge, does not lend itself to automatic machine assembly, and generally requires hand assembly and accordingly further increases the cost of such type hinges.

Easel hinges which eliminate such separate pin structure are known as indicated by that shown in U.S. Pat. No. 3,080,603 dated Mar. 12, 1963. Such hinge structures however are generally of overly complex configuration.

The need thus exists for a simple, low cost, easel hinge construction which can be readily made and assembled on automatic machinery and which does not utilize either a separate hinge pin or complex hinge or stop mechanisms.

SUMMARY OF THE INVENTION

The present invention accomplishes these aims while avoiding those prior art shortcomings by the provision of an easel hinge comprising an outer hinge plate and an inner hinge plate both having curled barrels, the inner barrel being positioned within the outer barrel for relative rotational movement therewith without the use of a separate hinge pin. The extent of such movement, and thus the maximum angular separation of the hinge plates is positively limited by contact of outer wall portions of the inner hinge plate with the entire longitudinal free edge of the outer curl, and any relative longitudinal movement of the hinge plates is prevented by the positioning of an integral inner barrel tab within a slot formed in the outer barrel.

It is therefore a primary object of the instant invention to provide an easel hinge which is of simple, low cost construction and which can be readily made and assembled by automatic machinery.

Another object of this invention is the provision of an easel hinge construction which successfully eliminates the need of a separate hinge pin.

A further object is the provision of an easel hinge construction having positive stop means for limiting the relative angular movement between the hinge plates which acts upon a large surface area thus forming a particularly strong stop means and/or enabling the production of the hinge from lighter weight material.

Still another object is the provision of an easel hinge having means for preventing relative longitudinal movement of the assembled hinge plates, and which will not hinder the automatic machine assembly and operative positioning of such hinge plates.

Other objects, features and advantages of the invention will become apparent as the description thereof proceeds when considered in connection with the accompanying illustrative drawings. cl DESCRIPTION OF THE DRAWINGS In the drawings which illustrate the best mode presently contemplated for carrying out the present invention:

DESCRIPTION OF THE INVENTION

Figure 1:
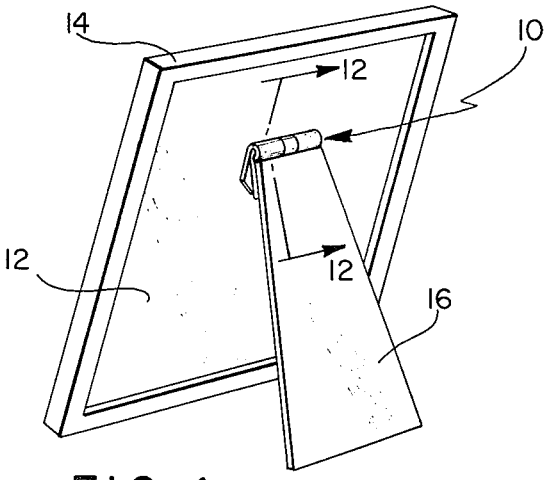
FIG. 1 is a perspective view of an easel hinge constructed in accordance with the instant invention applied to an easel type picture frame.
Figure 12:
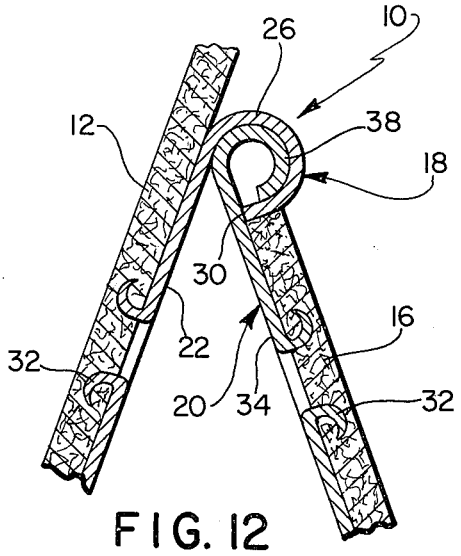
FIG. 12 is an enlarged sectional view taken along the line 12—12 of FIG. 1.
Figure 2:
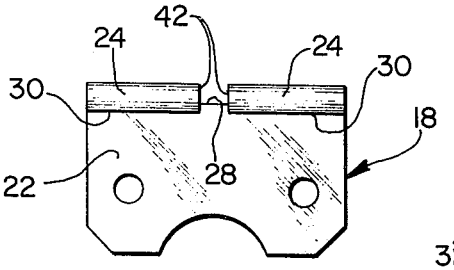
FIG. 2 is a front plan view of the outer hinge plate which forms a part of the instant invention.
Figure 3:
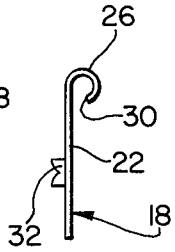
FIG. 3 is a side view of the outer hinge plate shown in FIG. 2.
Figure 4:
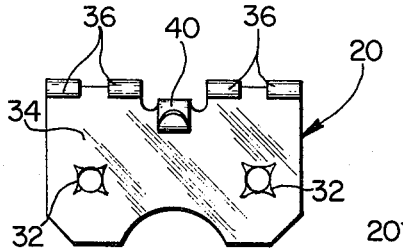
FIG. 4 is a front plan view of the inner hinge plate which forms a part of the instant invention in position for longitudinal assembly with the outer hinge plate shown in FIG. 2.
Figure 7:
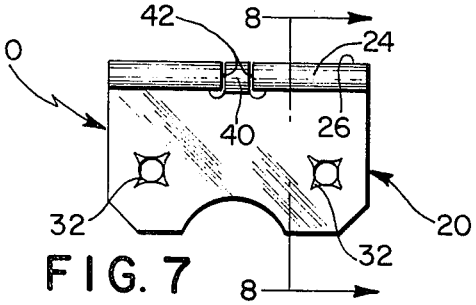
FIG. 7 is a front plan view of the two hinge plates in assembled operative position thus forming the easel hinge of the instant invention.
Figure 8:
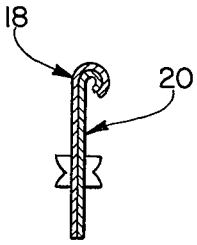
FIG. 8 is a side sectional view of the assembled easel hinge shown in FIG. 7 taken along the line 8—8 of FIG. 7.
Figure 11:
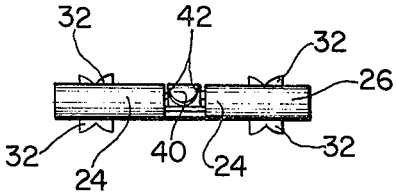
FIG. 11 is a top plan view thereof.

Referring now to the drawings, an easel hinge constructed in accordance with the instant invention shown generally at 10 serves to connect backing 12 of frame 14 to its support leg 16. As will be seen most clearly from FIGS. 7, 8 and 11, the easel hinge 10 comprises an outer hinge plate 18 and an inner hinge plate 20 formed from any suitably stiff but workable material such as sheet metal. The construction of the outer hinge plate 18 is best seen with reference to FIGS. 2 and 3 wherein a relatively flat leaf portion 22 thereof terminates at one end thereof in curled barrel segments 24 forming an outer hinge barrel 26. Any suitable technique may be utilized in producing the curved barrel configuration depicted although conventionally such is accomplished by the progressive feeding of sheet material into a closed curved die. The barrel 26 is of a relatively open curl, that is, it is not tightly curled upon itself. A slot 28 is formed intermediate and preferably centrally of said barrel 26 and thus separates the barrel segments 24 which form the outer barrel 26 from each other. The barrel 26 also terminates in a longitudinally free edge 30 which essentially, with the exception of slot 28, extends entirely acorss the longitudinal extent of hinge plate 18. The leaf 22 is further provided with a suitable number of rosettes 32 projecting from the outer side thereof so as to provide connection points for the conventional attachment thereto of the backing 12, generally formed of cardboard or the like.

Figure 5:
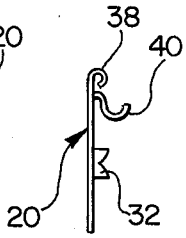
FIG. 5 is a side view of the inner hinge plate shown in FIG. 4.

Referring now to FIS. 4 and 5, the construction of the inner hinge plate 20 is best seen as comprising a relatively flat leaf portion 34 terminating at one end thereof in a plurality of curled barrel segments 36 forming an inner barrel 38. The barrel 38 is of a relatively closed curl, that is, it is tightly curled upon itself. Such closed configuration is facilitated by the relatively narrow width of each inner barrel segment 36 which reduces the overall resistance to bending and the spacing apart of each such segment provides access for the curling dies indicated as being generally used for this purpose. The direction of curl of inner barrel 38 is further preferably the same as that of outer barrel 26 to assure smooth hinge action and a close face to face positioning of the hinge plates when assembeld and in operative position. An integrally formed tab 40 is provided intermediate said inner barrel 38 and preferably centrally thereof. In the unassembled position depicted in FIG. 5 such tab is shown bent outwardly from the upper surface of leaf 34 in a pronounced manner for a reason that will be hereinafter apparent. Rosettes 32 which project outwardly from the leaf 34 are provided as the means for fastening support leg 16 thereto in a known manner.

Figure 6:
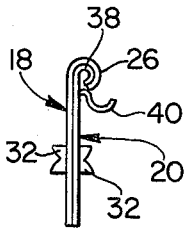
FIG. 6 is a side view showing the outer and inner hinge plates in assembled but not operative position.
Figure 10:
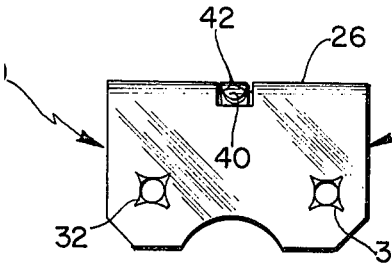
FIG. 10 is a rear plan view of the easel hinge shown in FIG. 7.

In assembling the hinge plates 18 and 20, it will be apparent that due to the relatively tighter and thus, assuming equal thickness hinge material, smaller radial extent of the inner barrel 38, such is free to slide longitudinally of the outer barrel 26. Such access is further facilitated by the initial outward bend of the tab 40 which permits such tab to pass along the outer barrel without interference therewith as best shown by FIG. 6 until the hinge plates are in coextensive face to face relation and the tab 40 aligned with slot 28. The tab 40 is then bent upwardly and inwardly into position within the slot 28 and in abutting relation with inner portions 42 of the outer barrel segments 24. When in assembled operative position the above described tab-slot interaction affords a positive, straightforward and inexpensive means for preventing relative longitudinal movement between the hinge plates 18 and 20. The assembly of such positioning means may also be accomplished by automatic machinery as may the other assembly operations previously discussed.

Figure 9:
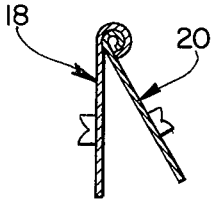
FIG. 9 is a side sectional view similar to FIG. 8 but showing the hinge plates spread to the limit of their angular separation.

In such assembled condition the hinge plates 18 and 20 are free for relative rotational movement about the hinge point formed by their respective barrels 26 and 38, by reason of the enclosure of inner barrel 38 within outer barrel 26. In this regard the outer barrel 26, by curling around and towards its supporting leaf 22 to define an arc preferably about 270° or greater, not only positions the longitudinal free edge 30 so as to limit relative hinge plate movement within the acute arcuate opening therein provided, but further assures that sufficient enclosure of the inner barrel 38 within the outer barrel 26 is obtained so as to prevent its accidental displacement through such opening. The hinge plates are thus supported for free movement from a closed position wherein the inner sides of their leaves 22 and 34 are face to face as in FIG. 8 to an open position wherein the outer side of leaf 20 abuts the longitudinal free edge 30 of the outer barrel 26 as in FIG. 9.

This movement of the inner leaf 20 against the longitudinal free edge 30 of the outer hinge plate provides a positive limit to the amount of separation possible between the leaves 22 and 34. Also by acting, with the exception of the width of slot 28, across the entire width available in the outer hinge, the force required to restrain further leaf separation is distributed over as large an area as available and accordingly provides a stronger stop means and/or enables the hinge of the instant invention to use thinner gauge materials than used by prior art hinge constructions having less effective stop means. It should also be noted that the spacing between the free edge 30 and the outer leaf 22, and thus the available limit of separation between the leaves, can be varied by adjusting the relative curl tightness and extent of the barrel 26.

While there is shown and described herein certain specific structure embodying the invention, it will be manifest to those skilled in the art that various modifications of the parts may be made without departing from the spirit and scope of the underlying inventive concept and that the same is not limited to the particular forms herein shown and described except insofar as indicated by the scope of the appended claims.

What is claimed is:

1. An easel hinge comprising, an outer hinge plate and an inner hinge plate directly interconnected thereto without a hinge pin, said outer hinge plate having a relatively flat leaf portion terminating in a curled barrel at one end thereof, said outer barrel having a relatively open curl terminating in a longitudinal free edge generally directed towards and spaced from the inner side of said outer leaf, said inner hinge plate having a relatively flat leaf portion terminating in a curled barrel at one end thereof, said inner barrel being curled in the same direction as said outer barrel and being positioned therein for relative rotational movement so as to permit acute angular separation between said hinge plates from a closed position wherein the inner sides of said leaves are face to face to an open position wherein the outer side of said inner leaf abuts said longitudinal free edge of said outer barrel, and means for preventing relative longitudinal movement of said plates.

2. In the easel hinge of claim 1, said hinge plates formed of essentially equal thickness material and said inner barrel having a relatively tight curl.

3. In the easel hinge of claim 2, said inner barrel formed of a plurality of separate longitudinally spaced segments to facilitate formation of such tight curl.

4. In the easel hinge of claim 1, said means for preventing relative longitudinal movement of said plates comprising an intermediately positioned slot in said outer barrel separating said outer barrel into barrel segments and said inner barrel having an intermediately positioned integral tab, said tab being positioned in said slot in abutting relation with inner portions of said outer barrel segments.

5. In the easel hinge of claim 4, said slot and said tab being positioned centrally of their respective hinge plates, and said tab being curled to substantially the same diameter as that of said outer barrel segments whereby said tab and said outer barrel segments define a substantially flush surface.

6. An easel hinge comprising, an outer hinge plate, an inner hinge plate interconnected thereto and means integral with said plates for preventing relative longitudinal movement thereof, said outer hinge plate havng a relatively flat leaf portion terminating in a curled barrel at one end thereof, said outer barrel comprising separate segments spaced from each other by an intermediately positioned slot, said inner hinge plate having a relatively flat leaf portion having both a plurality of curled barrel segments forming an inner barrel and an intermediately positioned integral tab at one end thereof, said inner barrel positioned for relative rotational movement within said outer barrel and said tab positioned in said slot and in abutting relation with inner portions of said outer barrel segments thereby preventing relative longitudinal movement of said plates, said tab being curled to substantially the same diameter as that of said outer barrel segments whereby said tab and said outer barrel segments define a substantially flush surface.

7. In the easel construction of claim 6, said tab being initially displaced outwardly from said inner curl so that said inner barrel is freely longitudinally slidable into said outer barrel for assembling said plates in operative position.

8. In the easel construction of claim 6, said slot and said tab being positioned centrally of their respective hinge plates.

* * * * *